US008145107B2

(12) United States Patent
Tanaka et al.

(10) Patent No.: US 8,145,107 B2
(45) Date of Patent: Mar. 27, 2012

(54) IMAGE FORMING APPARATUS AND IMAGE FORMING METHOD

(75) Inventors: Shinichi Tanaka, Shiojiri (JP); Satoshi Chiba, Suwa (JP); Koichi Kamijo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 239 days.

(21) Appl. No.: 12/726,178

(22) Filed: Mar. 17, 2010

(65) Prior Publication Data

US 2010/0247176 A1 Sep. 30, 2010

(30) Foreign Application Priority Data

Mar. 25, 2009 (JP) ..... 2009-073914

(51) Int. Cl.
*G03G 15/01* (2006.01)
*G03G 15/20* (2006.01)

(52) U.S. Cl. ..... 399/304; 399/313

(58) Field of Classification Search ..... 399/304, 399/313, 316
See application file for complete search history.

(56) References Cited

U.S. PATENT DOCUMENTS 5,016,056 A * 5/1991 Johnson et al. ..... 399/304
5,402,217 A * 3/1995 Kimura et al. ..... 399/304
6,389,242 B1 5/2002 Watanabe

FOREIGN PATENT DOCUMENTS

JP 2002-156839 5/2002

* cited by examiner

*Primary Examiner* — Hoang Ngo
(74) *Attorney, Agent, or Firm* — Workman Nydegger

(57) ABSTRACT

An image forming apparatus includes: a transfer belt to which an image is transferred; a belt tension roller around which the transfer belt is looped; a transfer roller that includes a shaft and a recessed portion which is formed in an axial direction of the transfer roller and has a first edge formed in an opening edge in one side of a rotation direction of the transfer roller and a second edge formed in an opening edge in the other side opposite to the one side; and a support member that is arranged in the shaft of the transfer roller.

7 Claims, 8 Drawing Sheets

IMAGE FORMING APPARATUS AND IMAGE FORMING METHOD

BACKGROUND

1. Technical Field

The present invention relates to an image forming apparatus and image forming method by which an image is formed by developing a latent image formed on the photosensitive body using a liquid developer containing a toner and a carrier, transferring such a developer onto a medium such as a recording sheet, and fusing and fixing a toner image on the transferred medium.

2. Related Art

Various wet type image forming apparatuses have been proposed in which a latent image is developed using a high-viscosity liquid developer obtained by dispersing a toner containing solid elements in a liquid solvent, and an electrostatic latent image is made visible. The developer used in such a wet type image forming apparatus is obtained by suspending solid contents (toner particles) in a high-viscosity organic solvent (a carrier liquid) which is made of silicon oil, mineral oil, cooking oil, or the like and has an electric insulation property. The toner particles have a diameter of about 1 μm which is significantly minute. Since the wet type image forming apparatus uses such minute toner particles, it can provide a higher quality image in comparison with the dry type image forming apparatus which uses powder toner particles having a diameter of about 7 μm. For example, the image forming apparatus using such a liquid developer disclosed in JP-A-2002-156839 includes: an image forming device which forms an electrostatic latent image on an image holding body; a developing device which develops the electrostatic latent image on the image holding body using a liquid developer obtained by dispersing developer particles in a solvent to make a visible image; an intermediate transfer medium which abuts on the image holding body to transfer the visible image on the image holding body thereto; a transfer device which has a backup member that abuts on the intermediate transfer medium and transfers the visible image on the intermediate transfer medium to the transfer target body by pressing the transfer target body to the intermediate transfer medium using the backup member; a determination device which determines the type of the transfer target body to which the visible image is transferred by the transfer device; and a control device which variably controls a pressing force applied to the transfer target body by the backup member depending on the type of the transfer target body determined by the determination device.

The image forming apparatus disclosed in JP-A-2002-156839 includes the backup member that abuts on the intermediate transfer medium and a pressing member for pressing the transfer target body to the intermediate transfer medium using the backup member. However, the applicant proposes that a recessed portion be provided in a member corresponding to the backup member of the image forming apparatus disclosed in JP-A-2002-156839 and a transfer material gripping mechanism for gripping the transfer material be disposed in the recessed portion. In this case, there was a problem that it does not appropriately operate just by providing the pressing member of the backup member when the corresponding recessed portion and the intermediate transfer medium face each other.

SUMMARY

According to an aspect of the invention, there is provided an image forming apparatus including: a transfer belt to which an image is transferred; a belt tension roller around which the transfer belt is looped; a transfer roller that includes a shaft and a recessed portion which is formed in an axial direction of the transfer roller and has a first edge formed in an opening edge in one side of a rotation direction of the transfer roller and a second edge formed in an opening edge in the other side opposite to the one side; and a support member that is arranged in the shaft of the transfer roller.

It is preferable that the first edge is a curved surface having a first curvature, and the second edge is a curved surface having a second curvature different from the first curvature.

It is preferable that the second edge has a transfer material gripping section for gripping a transfer material, and the first curvature is larger than the second curvature.

It is preferable that the first edge has a tapered surface, and the second edge has a tapered surface.

It is preferable that an area of the tapered surface of the first edge is larger than an area of the tapered surface of the second edge.

It is preferable that the image forming apparatus further includes a second support member which is arranged in an end of the shaft of the belt tension roller and abuts on the support member, and the support member and the second support member abut on each other to control positions of the transfer roller and the belt tension roller.

According to an another aspect of the invention, there is provided an image forming method including: supporting an image on a transfer belt looped around a belt transfer roller; transferring the image to a transfer material by passing the transfer material using the transfer belt through a transfer nip formed by making a belt tension roller abut on a transfer roller that includes a shaft and a recessed portion which is formed in an axial direction of the transfer roller and has a first edge formed in an opening edge in one side of a rotation direction of the transfer roller and a second edge formed in an opening edge in the other side opposite to the one side; and making a support member arranged in the shaft of the transfer roller abut on the second support member arranged in a shaft end of the belt tension roller after the image is transferred to the transfer material.

According to the image forming apparatus and the image forming method of the invention, while the secondary transfer roller is pressed to the belt tension roller side, the shaft of the secondary transfer roller has the abutting member, and the shaft of the belt tension roller has the abutting target member. As a result, the secondary transfer roller can be used to apply a predetermined pressure to the transfer nip when the recessed portion does not make contact with the transfer belt. Simultaneously, the positional relationship between the secondary transfer roller and the belt tension roller can be maintained when the recessed portion faces the transfer belt.

According to the image forming apparatus and the image forming method of the invention, even when the secondary transfer roller has the recessed portion, transition can be seamlessly made without generating vibration between a constant load state in which a constant pressure is applied to the transfer nip and a fixed position state in which the transfer roller and the belt tension roller are maintained in a fixed positional relationship. As a result, it is possible to suppress influences on an image forming process and prevent image quality degradation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
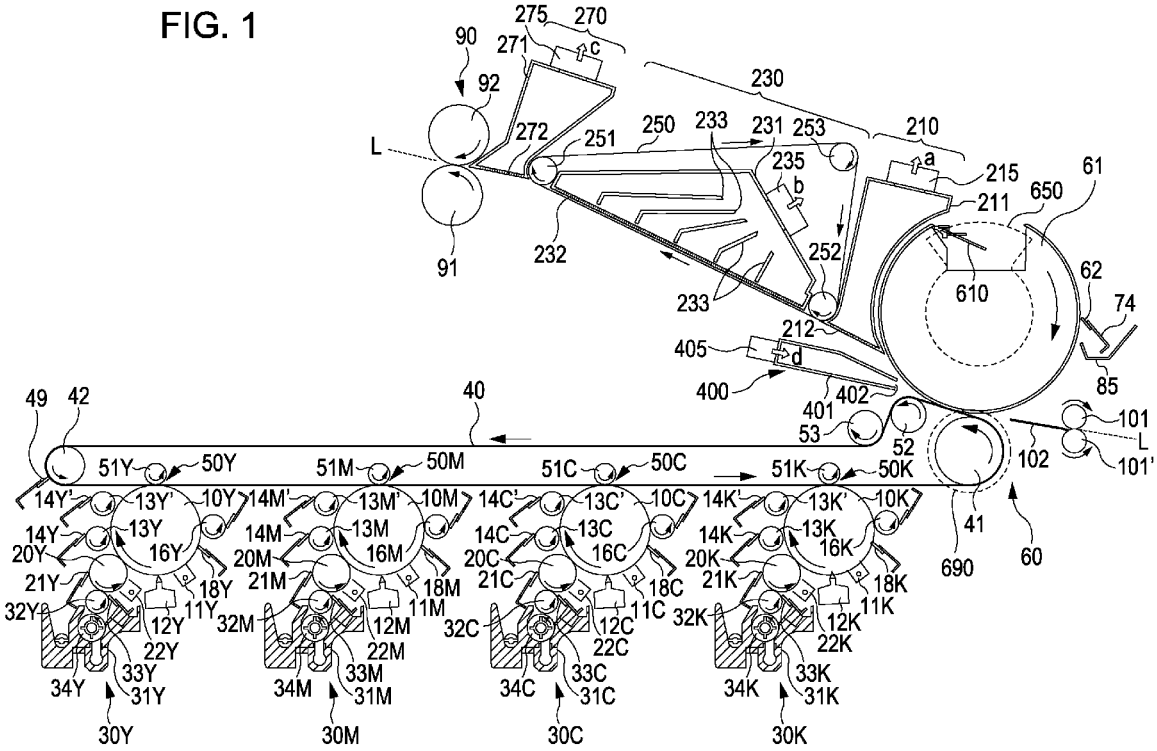
FIG. 1 illustrates main components of an image forming apparatus according to an embodiment of the invention.

Hereinafter, embodiments of the invention will be described with reference to the accompanying drawings. FIG. 1 illustrates main components of the image forming apparatus according to an embodiment of the invention. In image forming sections corresponding to each color disposed in the center of the image forming apparatus, developing devices 30Y, 30M, 30C, and 30K are disposed in a lower part of the image forming apparatus, whereas a transfer belt 40, a secondary transfer section (a secondary transfer unit) 60, a fixing unit 90, or the like are disposed in an upper part of the image forming apparatus. Particularly, the entire installation area of the image forming apparatus can be suppressed by laying out the fixing unit 90 over the transfer belt 40. According to the present embodiment, it is possible implement such a layout because a transfer material, such as paper to which a secondary transfer has been executed by the secondary transfer unit 60, is transported to the fixing unit 90 while being fed by the transfer material transport device 230, the suction devices 210 and 270, or the like.

The developing devices 30Y, 30M, 30C, and 30K include photosensitive bodies 10Y, 10M, 10C, and 10K, corona chargers 11Y, 11M, 11C, and 11K, and exposure units 12Y, 12M, 12C, and 12K, respectively, such as an LED array in order to form an image using a toner. The photosensitive bodies 10Y, 10M, 10C, and 10K are uniformly charged by the corona chargers 11Y, 11M, 11C, and 11K, and exposure is performed by the exposure units 12Y, 12M, 12C, and 12K based on an input image signal, so that the electrostatic latent image is formed on the charged photosensitive bodies 10Y, 10M, 10C, and 10K.

The developing devices 30Y, 30M, 30C, and 30K generally include developing rollers 20Y, 20M, 20C, and 20K, developer reservoirs 31Y, 31M, 31C, and 31K for storing yellow Y, magenta M, cyan C, and black K liquid developers, anilox rollers 32Y, 32M, 32C, and 32K that function as application rollers for applying the liquid developers of each color from the developer reservoirs 31Y, 31M, 31C, and 31K to the developing rollers 20Y, 20M, 20C, and 20K, or the like. The developing devices 30Y, 30M, 30C, and 30K develop the electrostatic latent image formed on the photosensitive bodies 10Y, 10M, 10C, and 10K using the liquid developers of each color.

The transfer belt 40 is an endless belt which is looped around a driving roller 41 and tension rollers 42, 52, and 53 and rotatably driven by the driving roller 41 while abutting on the photosensitive bodies 10Y, 10M, 10C, and 10K at the primary transfer units 50Y, 50M, 50C, and 50K. In the primary transfer units 50Y, 50M, 50C, and 50K, the primary transfer rollers 51Y, 51M, 51C, and 51K are disposed opposite to the photosensitive bodies 10Y, 10M, 10C, and 10K, respectively, by pinching the transfer belt 40. The primary transfer units 50Y, 50M, 50C, and 50K sequentially overlap and transfer the toner images of each color developed on the photosensitive bodies 10Y, 10M, 10C, and 10K to the transfer belt 40 by setting the positions abutting on the photosensitive bodies 10Y, 10M, 10C, and 10K as transfer positions to form a full-color toner image.

In the secondary transfer unit 60, the secondary transfer roller 61 is disposed to face the belt driving roller 41 by pinching the transfer belt 40, and additionally, a cleaning device including a secondary transfer roller cleaning blade 62 is also disposed. At the transfer position where the secondary transfer roller 61 is disposed, a monochrome or full-color toner image formed on the transfer belt 40 is transferred to the transfer material such paper, film, or fabric transported along the transfer material transport path L.

In the downstream of the transfer material transport path L, an air blower 400 for discharging air to a gap between the transfer belt 40 and the secondary transfer roller 61, a first suction device 210, a transfer material transport device 230, and a second suction device 270 are sequentially arranged to transport the transfer material to the fixing unit 90. In the fixing unit 90, a monochrome or full-color toner image transferred to the transfer material such as paper is fused and fixed onto the transfer material such as paper.

The transfer belt 40 is looped around the tension roller 42 together with the belt driving roller 41 or the like. At the position looped by the tension roller 42 in the transfer belt 40, a cleaning device having a transfer belt cleaning blade 49 is disposed and abuts to clean remaining toner or carrier on the transfer belt 40. A force for driving the transfer belt 40 may be applied from the tension roller 42 to allow the belt driving roller 41 to be used as a simple belt tension roller.

The transfer material is supplied to the image forming device using a feeding device (not shown). The transfer material set in such a feeding device is output one by one to the transfer material transport path L with predetermined timing. In the transfer material transport path L, the transfer material is transported to the secondary transfer position using the gate rollers 101 and 101' and the transfer material guide 102, and a monochrome or full-color toner-developed image formed on the transfer belt 40 is transferred to the transfer material. As described above, the transfer material to which the secondary transfer has been performed is further transported to the fixing unit 90 using a transfer material transport unit mainly including the transport material transport device 230. The fixing unit 90 includes a heating roller 91 and a press roller 92 pressed to the heating roller 91 with a predetermined pressure to fuse and fix a monochrome or full-color toner image transferred to the transfer material on the transfer material such as paper by passing the transfer material through a nip by insertion.

While the developing device will now be described, since the image forming sections and the developing devices are similarly configured for each color, hereinafter, a description will focus only on the image forming section and the developing device of the yellow color Y.

In the image forming section, a photosensitive body cleaning roller 16Y, a photosensitive body cleaning blade 18Y, a corona charger 11Y, an exposure unit 12Y, a developing roller 20Y of the developing device 30Y, a first photosensitive body squeeze roller 13Y, and a second photosensitive body squeeze roller 13Y' are disposed along a rotation direction of the outer circumference of the photosensitive body 10Y.

The photosensitive body cleaning roller 16Y is rotated in a counterclockwise direction while abutting on the photosensitive body 10Y to clean remaining transfer liquid developer or transfer liquid developer not used in the transfer on the photosensitive body 10Y. A bias voltage for attracting the toner particles in the liquid developer is applied to the photosensitive body cleaning roller 16Y, and salvaged material of the photosensitive body cleaning roller 16Y is liquid developer which is rich in the solid contents and contains a large amount of toner particles.

In the downstream of the photosensitive body cleaning roller 16Y, the photosensitive body cleaning blade 18Y abutting on the photosensitive body 10Y cleans the liquid developer which is rich in the carrier contents on the photosensitive body 10Y.

In the developing device 30Y, a cleaning blade 21Y, an anilox roller 32Y, and a compaction corona generator 22Y are disposed in the outer circumference of the developing roller 20Y. A control blade 33Y that adjusts the amount of the liquid developer supplied to the developing roller 20Y abuts on the anilox roller 32Y. The liquid developer reservoir 31Y stores an auger 34Y. In a position facing the photosensitive body 10Y, the primary transfer roller 51Y of the primary transfer unit is disposed by pinching the transfer belt 40.

The photosensitive body 10Y is a photosensitive drum which is made of a cylindrical member in which a photosensitive layer such as an amorphous silicon photosensitive body is formed on its outer circumferential surface and rotated in a clockwise direction.

The corona charger 11Y is located in the upstream of the rotation direction of the photosensitive body 10Y with respect to the nip portion between the photosensitive body 10Y and the developing roller 20Y. The corona charger 11Y receives a voltage from a power supply (not shown) and charges the photosensitive body 10Y. The exposure unit 12Y is located in the downstream of the rotation direction of the photosensitive body 10Y with respect to the corona charger 11Y. The exposure unit 12Y irradiates light onto the photosensitive body 10Y charged by the corona charger 11Y to form a latent image on the photosensitive body 10Y. Herein, components such as rollers located in the former stage throughout the image forming process is described as being located in the upstream with respect to components such as rollers located in the latter stage.

The developing device 30Y includes a compaction corona generator 22Y which induces compaction and a developer reservoir 31Y which stores a liquid developer obtained by dispersing a toner within a carrier at a weight percentage of about 20%.

Further, the developing device 30Y includes a developing roller 20Y which supports the aforementioned liquid developer, an anilox roller 32Y which functions as an application roller for applying the liquid developer to the developing roller 20Y, a control blade 33Y which controls the amount of the liquid developer applied to the developing roller 20Y, an auger 34Y which supplies the liquid developer to the anilox roller 32Y while stirring and transporting the liquid developer, a compaction corona generator 22Y which makes the liquid developer held in the developing roller 20Y be in a compaction state, and a developing roller cleaning blade 21Y which cleans the developing roller 20Y.

The liquid developer stored in the developer reservoir 31Y is a nonvolatile liquid developer which is nonvolatile at room temperature and has a high concentration and a high viscosity instead of a generally-used volatile liquid developer which is volatile at room temperature and has a low concentration (e.g., 1 to 3 wt %) and a low viscosity using Isopar (a trademark of Exxon Mobil Corp.) as a carrier. In other words, the liquid developer according to the invention is a high viscosity liquid developer (of which a viscous elasticity is about 30 to 300 mPa·s when a shear velocity is 1000 (1/s) at a temperature of 25° C. using HAAKE RheoStress RS600) which has a toner solid content concentration of about 15 to 25% and is obtained by adding solid particles having an average particle diameter of 1 μm obtained by dispersing a colorant such as a pigment in thermoplastic resin to a liquid solvent such as an organic solvent, silicon oil, mineral oil, or cooking oil with a dispersant.

The anilox roller 32Y functions as an application roller which supplies and applies the liquid developer to the developing roller 20Y. The anilox roller 32Y is a cylindrical member having a corrugated surface formed by minutely and uniformly engraving spiral trenches on the surface to make it easier to hold the developer on the surface. By using the anilox roller 32Y, the liquid developer is supplied from the developer reservoir 31Y to the developing roller 20Y. As shown in FIG. 1, during the operation of the device, the auger 34Y is rotated in a counterclockwise direction to supply the liquid developer to the anilox roller 32Y, and the anilox roller 32Y is rotated in a counterclockwise direction to apply the liquid developer to the developing roller 20Y.

The control blade 33Y is an elastic blade obtained by coating an elastic material on the surface and includes a rubber portion made of, for example, urethane rubber abutting on the surface of the anilox roller 32Y or the like. The control blade 33Y controls the amount and the film thickness of the liquid developer held and transported by the anilox roller 32Y to adjust the amount of the liquid developer supplied to the developing roller 20Y.

The developing roller cleaning blade 21Y is made of, for example, rubber which abuts on the surface of the developing roller 20Y and is located in the downstream of the rotation direction of the developing roller 20Y with respect to the developing nip portion where the developing roller 20Y abuts on the photosensitive body 10Y so as to scrape off the liquid developer which has remained in the developing roller 20Y.

The compaction corona generator 22Y is an electric field application device for increasing a charging bias on the surface of the developing roller 20Y. By using the compaction corona generator 22Y, an electric field is applied from the compaction corona generator 22Y side to the developing roller 20Y at the compaction portion. Further, as the electric field application device for compaction, a compaction roller may be used instead of the corona discharge of the corona discharger shown in FIG. 1.

The developer that has been held and compacted in the developing roller 20Y is developed according to the latent image on the photosensitive body 10Y by applying a predetermined electric field to the developing nip portion where the developing roller 20Y abuts on the photosensitive body 10Y.

The developer remaining after the development is scraped off by the developing roller cleaning blade 21Y and dropped in a recovery section within the developer reservoir 31Y for recycling. Here, the carrier and the toner recycled in this manner are not in a mixed color state.

The photosensitive body squeeze device located in the upstream of the primary transfer is located in the downstream of the developing roller 20Y to face the photosensitive body 10Y in order to recover surplus carrier in the toner image developed by the photosensitive body 10Y. This photosensitive body squeeze device includes a first photosensitive body squeeze roller 13Y and a second photosensitive body squeeze roller 13Y' that are elastic roller members rotated by coming into contact with the photosensitive body 10Y and has the functions of recovering surplus carrier and excess fog toner from the toner image developed on the photosensitive body 10Y and increasing toner particle ratio within the developed (toner) image. Further, a predetermined bias voltage is applied to the photosensitive body squeeze rollers 13Y and 13Y'.

The surface of the photosensitive body 10Y enters the primary transfer unit 50Y after passing through the squeeze device including the first and second photosensitive body squeeze rollers 13Y and 13Y'.

At the primary transfer unit 50Y, the developer image developed on the photosensitive body 10Y is transferred to the transfer belt 40 using the primary transfer roller 51Y. At the primary transfer unit 50Y, the toner image on the photosensitive body 10 is transferred to the transfer belt 40 by using a transfer bias applied to the primary transfer backup roller 51. Here, the photosensitive body 10Y and the transfer belt 40 are moved at a constant velocity to reduce driving loads for rotation and movement and prevent disturbance on the developing toner of the photosensitive body 10Y.

By implementing a similar process to the aforementioned developing process of the developing device 30Y, magenta M, cyan C, and black K toner images are also formed on the photosensitive bodies 10M, 10C, and 10K in the developing devices 30M, 30C, and 30K, respectively. The transfer belt 40 passes through the nip of the primary transfer unit 50 of each of yellow Y, magenta M, cyan C, and black K colors so that developers (i.e., developing images) on the photosensitive bodies of each color are transferred and overlapped. Then, the transfer belt 40 enters the nip portion of the secondary transfer unit 60.

While the transfer belt 40 passing through the secondary transfer unit 60 revolves back to the primary transfer unit 50 in order to receive a transfer image, the transfer belt 40 is cleaned by the transfer belt cleaning blade 49 or the like in the upstream with respect to a location where the primary transfer unit 50 is operated.

The transfer belt 40 has a three-layer structure in which an elastic intermediate layer made of polyurethane is formed on a polyimide base layer, and a PFA surface layer is formed thereon. Such a transfer belt 40 is looped around a belt driving roller 41 and tension rollers 42, 52, and 53 in the polyimide base layer side and used in such a way that the toner image in the PFA surface layer side is transferred. Since the transfer belt 40 formed in such a way with a tension provides excellent tracking and responding capabilities to the surface of the transfer material, it is effectively used to transmit and transfer the toner particles, particularly those having a smaller diameter, to the recessed portion of the transfer material during the secondary transfer.

Figure 2:
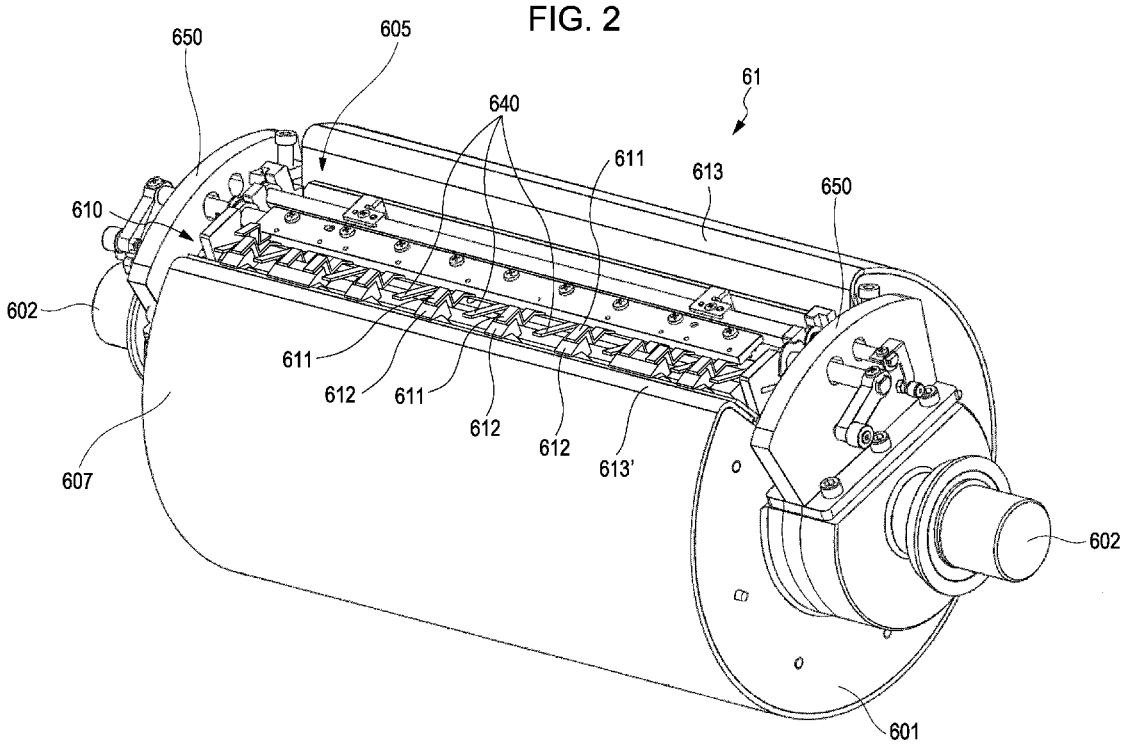
FIG. 2 is a perspective view illustrating a secondary transfer roller used in the image forming apparatus according to an embodiment of the invention.

Next, the secondary transfer roller 61 used in the image forming apparatus according to the present embodiment will be described in more detail. FIG. 2 is a perspective view illustrating the secondary transfer roller used in the image forming apparatus according to an embodiment of the invention. Referring to FIG. 2, in secondary transfer roller 61, a roller barrel 601, a roller shaft 602, a recessed portion 605, an elastic member 607, a transfer material gripping mechanism 610, a transfer material gripping portion 611, a transfer material gripping portion receptacle 612, a transfer material exfoliation member 640, an abutting member 650, and opening edges 613 and 613' are provided.

Since the roller shaft 602 is provided in both ends of the roller barrel 601 of the secondary transfer roller 61, the secondary transfer roller 61 is installed in the main body of the image forming apparatus so as to be able to freely pivot with respect to the roller shaft 602. The roller barrel 601 has a recessed portion 605 spanning in an axial direction. The transfer material gripping mechanism 610 is provided between an opening edge 613 of one end and the opening edge 613' of the other end of the recessed portion 605. The elastic member 607 is provided in a remaining part of the roller barrel 601 other than the recessed portion 605. The transfer material gripping mechanism 610 is provided for gripping or releasing the transfer material. The elastic member 607 is made of a semi-conductive elastic rubber layer having an electric resistance element. The toner image is transferred from the transfer belt 40 to the transfer material when the elastic member 607 passes through the secondary transfer nip in the secondary transfer unit while the transfer material is wound around the elastic member 607.

The transfer material gripping mechanism 610 includes a plurality of pairs of a transfer material gripping section 611 and a transfer material gripping section receptacle 612 that are discretely distributed along a roller axis direction and a plurality of transfer material exfoliation members 640 appropriately disposed along the roller axis direction between the pairs. All the transfer material gripping sections 611 are configured so as to be able to move so that the transfer material is gripped by pinching it with the transfer material gripping section receptacle 612 or released by opening up the space with the transfer material gripping section receptacle 612. All the transfer material exfoliation members 640 are operated to extract the transfer material gripped between the transfer material gripping section 611 and the transfer material gripping section receptacle 612 and to press it away from the secondary transfer roller 61 side.

In both ends of the roller shaft 602 of the secondary transfer roller 61, two abutting members 650 are provided. These abutting members 650 are configured such that the recessed portion 605 is provided in the secondary transfer roller 61 as seen from the roller axis direction, and the abutting surface is provided to match with the opened area. By making the abutting surface abut on the abutting target member which will be described later, the location between the secondary transfer roller 61 and the belt driving roller 41 can be controlled.

Figure 7:
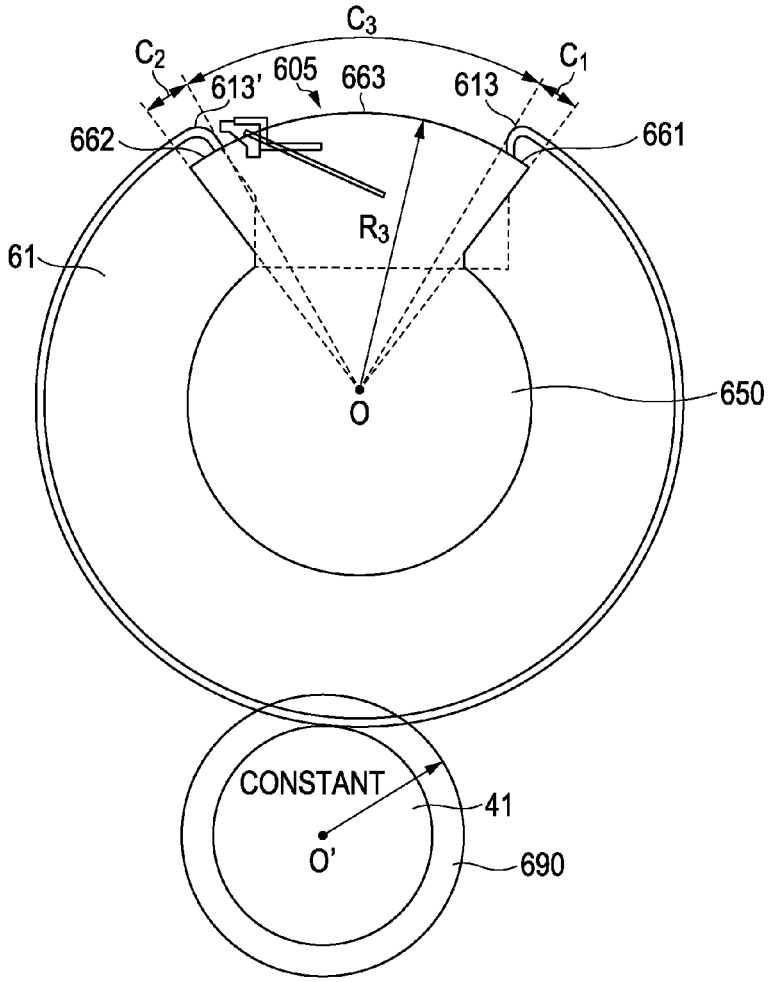
FIG. 7 is a diagram for describing a relationship between an abutting member and an abutting target member.
Figure 8:
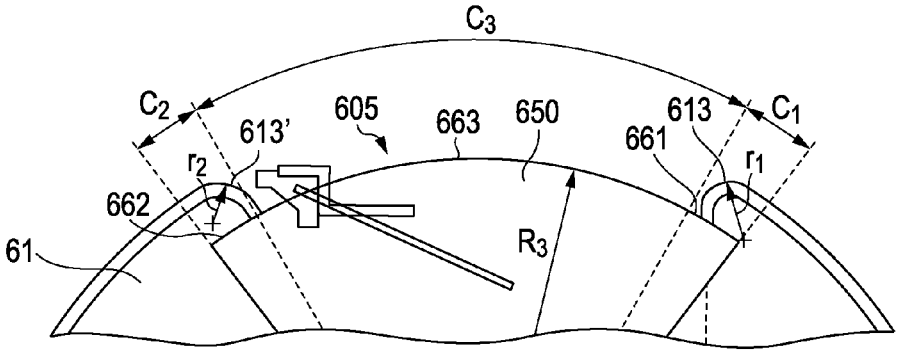
FIG. 8 is an enlarged view illustrating a vicinity of a recessed portion of an image forming apparatus according to an embodiment of the invention.

Next, a configuration will be described in detail which is used for controlling the location between the secondary transfer roller 61 and the belt driving roller 41 by applying a predetermined pressure to the secondary transfer nip in the secondary transfer section (secondary transfer unit) 60 including the secondary transfer roller 61 having a recessed portion 605 for storing the transfer material gripping mechanism 610. FIGS. 3A to 6B are diagrams for describing operations of the secondary transfer unit 60 in the image forming apparatus according to an embodiment of the invention. FIGS. 3A, 4A, 5A, and 6A illustrate the secondary transfer unit 60 as seen from the lateral face of the image forming apparatus, whereas FIGS. 3B, 4B, 5B, and 6B illustrate a schematic cross-section of the secondary transfer unit 60. Referring to FIGS. 3A to 6B, an abutting member 650, a pivot spindle 670, a frame member 671, a pressing member 672, a roller shaft 689 of the belt driving roller 41, and an abutting target member 690 are provided. FIG. 7 illustrates a configuration associated with the secondary transfer roller 61 and the belt driving roller 41 and a relationship between the abutting member 650 and the abutting target member 690. In FIG. 7, a first passing surface 661 of the abutting member 650, an abutting surface 663, and a second passing surface 662 are provided. FIG. 8 is an enlarged view illustrating a vicinity of the recessed portion of the image forming apparatus according to an embodiment of the invention.

In the secondary transfer unit 60, the roller shaft 602 of the secondary transfer roller 61 is installed in the frame member 671 so as to be able to pivot at both ends. The frame member 671 is able to pivot with respect to the pivot spindle 670 and is also pressed by the pressing member 672 toward an arrow direction in the drawing. In such a structure, the secondary transfer roller 61 is pressed toward the belt driving roller 41 so that a predetermined pressure can be applied to the secondary transfer nip between the secondary transfer roller 61 and the belt driving roller 41. By using the transfer bias and the transfer pressure provided by the secondary transfer nip, the toner particles on the transfer belt 40 are effectively transferred to the transfer material side at the secondary transfer nip.

At both ends of the roller shaft 602 of the secondary transfer roller 61, two abutting members 650 are provided. Two abutting target members 690 corresponding to the abutting members 650 are also provided at both ends of the roller shaft 689 of the belt driving roller 41. As shown in FIGS. 3B, 4B, 5B and 6B, the abutting members 650 and the abutting target members 690 are disposed to match in an axial direction.

The abutting member 650 includes an abutting surface 663 having a distance $R_3$ from the rotation center O of the secondary transfer roller 61, and first and second passing surfaces 661 and 662 disposed in both ends of the abutting surface 663 as shown in FIG. 7. The abutting surface 663 is provided in an area corresponding to the opening area (i.e., the abutting area $C_3$) in the recessed portion 605 of the secondary transfer roller 61 as seen in a roller axis direction. As the image forming apparatus is operated, the abutting surface 663 (the abutting area $C_3$) abuts on the abutting target member 690 in the belt driving roller 41 side when the recessed portion 605 faces the belt driving roller 41 (or the transfer belt 40). Thereby, the abutting target member 690 receives a pressing force from the secondary transfer roller 61 so that a distance and a positional relationship between the secondary transfer roller 61 and the belt driving roller 41 can be maintained.

Meanwhile, the opening edge 613 of the recessed portion 605 corresponds to the first passing surface 661 (the area $C_1$) as seen from the axial direction, but the opening edge 613 has a curved surface with a predetermined curvature R. Similarly, the opening edge 613' of the recessed portion 605 corresponds to the second passing surface 662 (the area $C_2$) as seen from the axial direction, but the opening edge 613' has a curved surface with a predetermined curvature R. Here, the curvature of the curved surface of the opening edge 613 is different from that of the opening edge 613'. More specifically, the curved surface of the opening edge 613 has a curvature $r_1$ (in the drawing, the cross denotes the center of the curvature circle), and the curved surface of the opening edge 613' has a curvature $r_2$ (in the drawing, the cross denotes the center of the curvature circle), where $r_1>r_2$. Here, $r_1$ is represented as "a first curvature," and $r_2$ is represented as "a second curvature" in the claims.

As the secondary transfer roller 61 and the belt driving roller 41 are rotated, there is a repeated alternation between a constant load state in which a constant pressure is applied to the secondary transfer nip and a fixed position state in which the secondary transfer roller 61 and the belt driving roller 41 are located in a fixed positional relationship. However, transition between each state can be seamlessly made without generating vibration by using the first and second passing surfaces 661 and 662 (the areas $C_1$ and $C_2$) provided in both sides of the abutting surface 663 and the curved surfaces provided in the opening edges 613 and 613'. As a result, it is possible to suppress influences on an image forming process and prevent image quality degradation. Additionally, the curvatures of the first and second passing surfaces 661 and 662 (the areas $C_1$ and $C_2$) are equal to the curvature of the abutting surface 663 (i.e., the abutting area $C_3$).

While, in the opening edge of the recessed portion 605, the curved surface having a curvature $r_2$ is formed to correspond to the side where the transfer material gripping mechanism 610 is provided, a margin of the leading end of the transfer material can be reduced by setting the curvature $r_2$ smaller than the curvature $r_1$.

The abutting member 650 shown in FIG. 7 is provided in the shaft of the secondary transfer roller 61, and a distances from the rotation center of the secondary transfer roller 61 to the outer circumference varies (e.g., distances are different from the rotation center to the abutting area $C_3$, the area $C_1$ or $C_2$, or other areas) so that it can function as a sort of a cam.

The abutting target member 690 has an outer circumference having a constant distance from the rotation center O' of the belt driving roller 41 and may be a bearing or the like. As each roller is rotated, the abutting target member 690 abuts on the abutting surface 663 of the abutting member 650 and receives the load from the secondary transfer roller 61 pressed by the pressing member 672 so that the distance and the positional relationship between the secondary transfer roller 61 and the belt driving roller 41 are maintained.

Figures 3A, 3B:
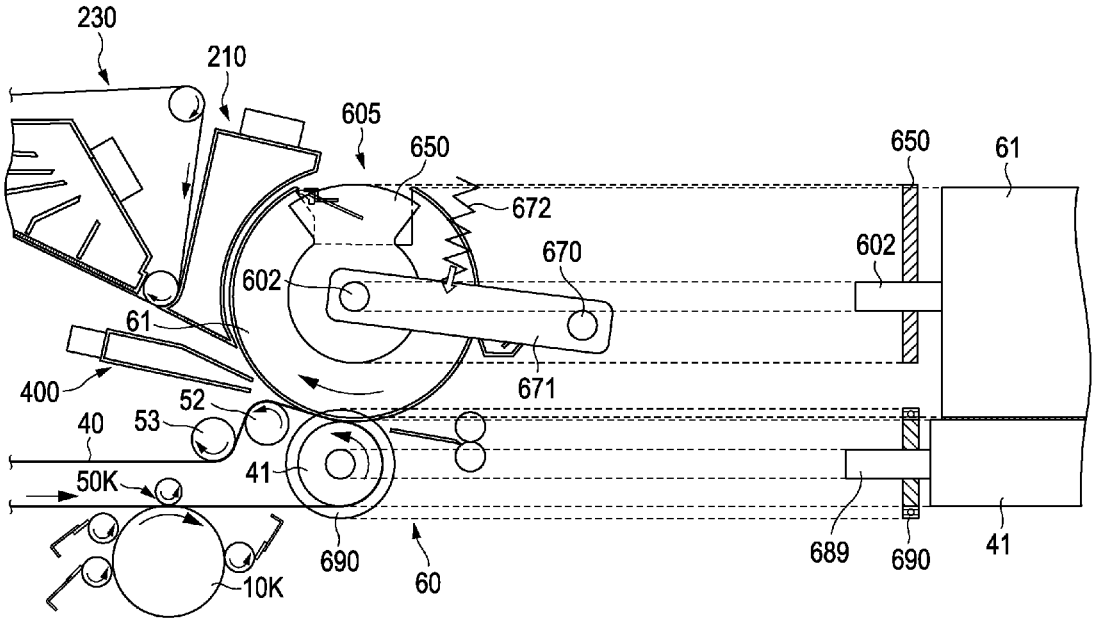
FIGS. 3A and 3B are diagrams for describing operations of a secondary transfer unit in an image forming apparatus according to an embodiment of the invention.
Figures 4A, 4B:
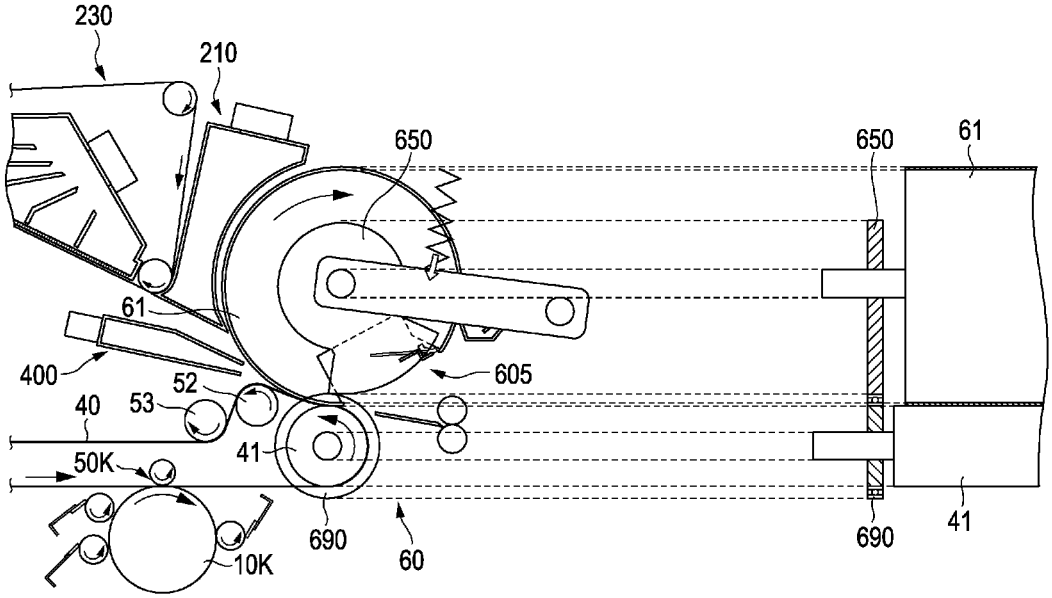
FIGS. 4A and 4B are diagrams for describing operations of a secondary transfer unit in an image forming apparatus according to an embodiment of the invention.
Figures 5A, 5B:
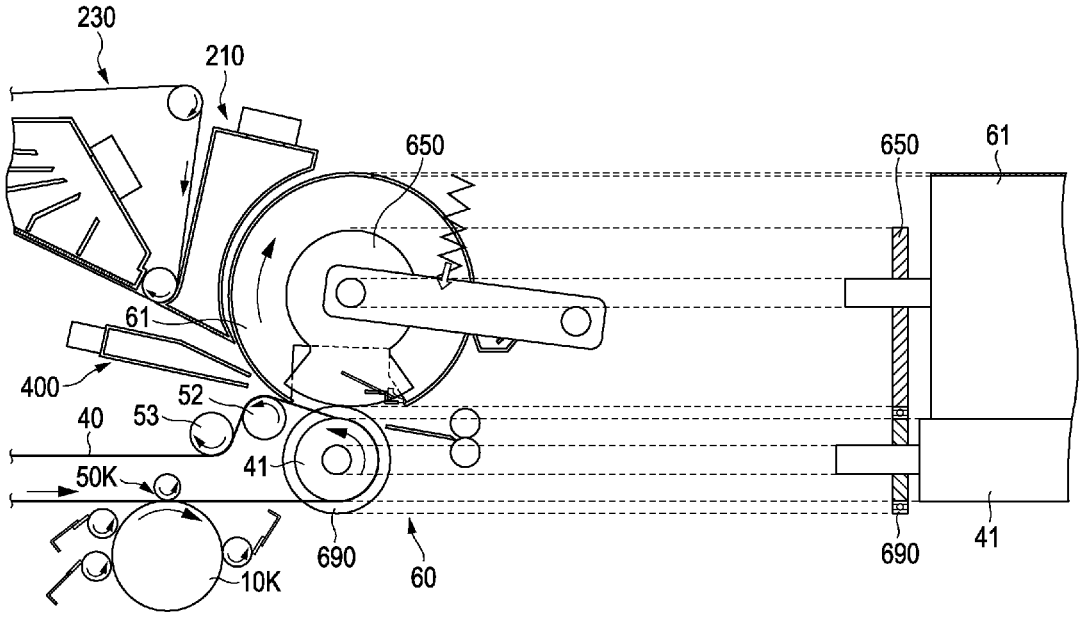
FIGS. 5A and 5B are diagrams for describing operations of a secondary transfer unit in an image forming apparatus according to an embodiment of the invention.
Figures 6A, 6B:
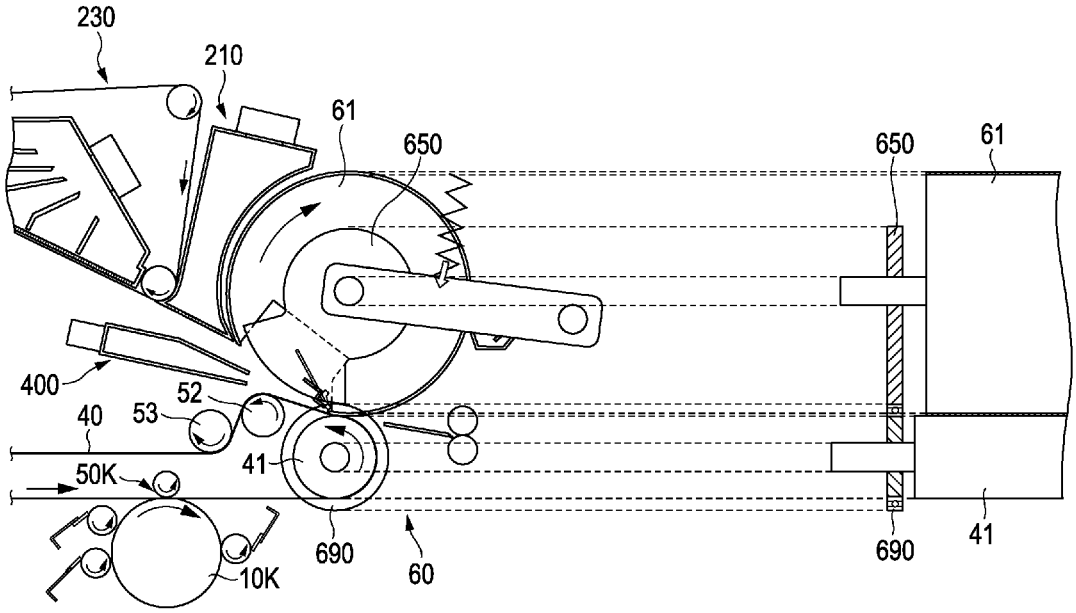
FIGS. 6A and 6B are diagrams for describing operations of a secondary transfer unit in an image forming apparatus according to an embodiment of the invention.

As each roller is rotated, the secondary transfer unit 60 is operated in sequence from the state shown in FIGS. 3A and 3B to the state shown in FIGS. 4A and 4B to the state shown in FIGS. 5A and 5B to the state shown in FIGS. 6A and 6B to the state shown in FIGS. 3A and 3B and so forth. In FIGS. 3A and 3B, the recessed portion 605 does not face the belt driving roller 41 (or the transfer belt 40). In this state, the pressing force from the pressing member 672 is applied to the secondary transfer nip to obtain a predetermined transfer pressure, and an appropriate transfer bias is applied between the secondary transfer roller 61 and the belt driving roller 41 so that the toner particles on the transfer belt 40 is transferred to the transfer material side at the secondary transfer nip. In the state shown in FIGS. 3A and 3B, the abutting member 650 and the abutting target member 690 are perfectly separated from each other.

FIGS. 4A and 4B illustrate a state just before the recessed portion 605 reaches the belt driving roller 41 (or the transfer belt 40) as the rotation of each roller progresses. At this moment, as each roller is rotated, the first passing surface 661 (the area $C_1$) of the abutting member 650 is slowly moved closer to the abutting target member 690. In other words, a distance between the first passing surface 661 (the area $C_l$) and the abutting target member 690 is slowly shortened. As the rotation further progresses, the abutting member 650 abuts on the abutting target member 690 at the border between the first passing surface 661 (the area $C_1$) and the abutting surface 663 (the area $C_3$), and the load from the secondary transfer roller 61 is applied to the abutting target member 690 so that the distance and the positional relationship between the secondary transfer roller 61 and the belt driving roller 41 are maintained. At the moment the abutting member 650 abuts on the abutting target member 690, the recessed portion 605 faces the belt driving roller 41 (or the transfer belt 40).

FIGS. 5A and 5B illustrate a state that the rotation of each roller further progresses. Referring to FIGS. 5A and 5B, the recessed portion 605 perfectly faces the belt driving roller 41 (or the transfer belt 40), and the abutting surface 663 (the abutting area $C_3$) of the abutting member 650 abuts on the abutting target member 690 while each roller is rotated. At this moment, the pressing force of the secondary transfer roller 61 pressed by the pressing member 672 is applied to the abutting target member 690 so that the distance and the positional relationship between the secondary transfer roller 61 and the belt driving roller 41 are maintained.

As the rotation of each roller further progresses, at the border between the abutting surface 663 (the abutting area $C_3$) of the abutting member 650 and the second passing surface 662 (the area $C_2$), the abutting member 650 is separated from the abutting target member 690, and further, the second passing surface 662 (the area $C_2$) of the abutting member 650 slowly recedes from the abutting target member 690. FIGS. 6A and 6B illustrate this state. At this moment, as the recessed portion 605 recedes from the belt driving roller 41 (or the transfer belt 40), the elastic member 607 of the secondary transfer roller 61 makes contact with the transfer belt 40, and a pressing force from the pressing member 672 is applied to the secondary transfer nip. Furthermore, the abutting member 650 is separated from the abutting target member 690, and the load from the abutting member 650 to the abutting target member 690 is also released.

According to the present embodiment, while the secondary transfer roller 61 is pressed to the belt driving roller 41 side, the shaft of the secondary transfer roller 61 has the abutting member 650, and the shaft of the belt driving roller 41 has the abutting target member 690. As a result, the secondary transfer roller 61 can be used to apply a predetermined pressure to the transfer nip when the recessed portion 605 does not make contact with the transfer belt. Simultaneously, the positional relationship between the secondary transfer roller 61 and the belt driving roller 41 can be maintained when the recessed portion faces the transfer belt.

According to the present embodiment, even when the secondary transfer roller 61 has the recessed portion 605, transition can be seamlessly made without generating vibration between a constant load state in which a constant pressure is applied to the secondary transfer nip and a fixed position state in which the secondary transfer roller 61 and the belt driving roller 41 are maintained in a fixed positional relationship. As a result, it is possible to suppress influences on an image forming process and prevent image quality degradation.

Figure 9:
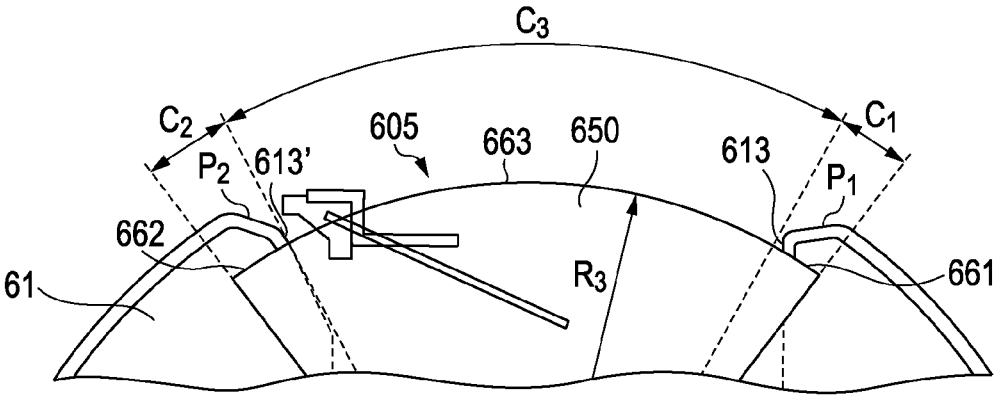
FIG. 9 is an enlarged view illustrating the vicinity of the recessed portion of the image forming apparatus according to another embodiment of the invention.

Another embodiment of the invention will now be described. FIG. 9 is an enlarged view illustrating a vicinity of the recessed portion of the image forming apparatus according to another embodiment of the invention. In the present embodiment, the opening edges 613 and 613' have different shapes from those of the aforementioned embodiments, but in other aspects, the configurations are the same.

While the opening edges 613 and 613' are curved in the aforementioned embodiments, they are tapered according to the present embodiment. Here, the tapered surface of the opening edge 613 has a different area from the tapered surface the opening edge 613', where the area of the tapered surface of the opening edge 613 is larger than the area of the tapered surface of the opening edge 613'.

According to the configuration described above, transition can be seamlessly made without generating vibration between a constant load state in which a constant pressure is applied to the secondary transfer nip and a fixed position state in which the secondary transfer roller 61 and the belt driving roller 41 are maintained in a fixed positional relationship. As a result, it is possible to suppress influences on an image forming process and prevent image quality degradation. According to the present embodiment, it is possible to obtain similar effects to those of aforementioned embodiments.

While various embodiments have been described herein, it should be construed that other embodiments that can be made by appropriately combining configurations of each embodiment are also included in the scope of the invention.

The entire disclosure of Japanese Patent Application No: 2009-73914, filed Mar. 25, 2009 is expressly incorporated by reference herein.

What is claimed is:

1. An image forming apparatus comprising:

a transfer belt to which an image is transferred;

a belt tension roller around which the transfer belt is looped;

a transfer roller that includes a shaft and a recessed portion which is formed in an axial direction of the transfer roller and has a first edge formed in an opening edge in one side of a rotation direction of the transfer roller and a second edge formed in an opening edge in the other side opposite to the one side; and a support member that is arranged in the shaft of the transfer roller.

2. The image forming apparatus according to claim 1, wherein the first edge is a curved surface having a first curvature, and the second edge is a curved surface having a second curvature different from the first curvature.

3. The image forming apparatus according to claim 1, wherein the second edge has a transfer material gripping section that grips a transfer material, and the first curvature is larger than the second curvature.

4. The image forming apparatus according to claim 1, wherein the first edge has a tapered surface, and the second edge has a tapered surface.

5. The image forming apparatus according to claim 4, wherein an area of the tapered surface of the first edge is larger than an area of the tapered surface of the second edge.

6. The image forming apparatus according to claim 1, further comprising a second support member which is arranged in an end of the shaft of the belt tension roller and abuts on the support member, wherein the support member and the second support member abut on each other to control positions of the transfer roller and the belt tension roller.

7. An image forming method comprising:

supporting an image on a transfer belt looped around a belt tension roller;

transferring the image to a transfer material by passing the transfer material through a transfer nip formed by the transfer belt, the belt tension roller and a transfer roller that includes a shaft and a recessed portion which is formed in an axial direction of the transfer roller and has a first edge formed in an opening edge in one side of a rotation direction of the transfer roller and a second edge formed in an opening edge in the other side opposite to the one side; and making a support member arranged in the shaft of the transfer roller abut on the second support member arranged in a shaft end of the belt tension roller after the image is transferred to the transfer material.

* * * * *